US005183560A

United States Patent [19]

Roof et al.

[11] Patent Number: 5,183,560

[45] Date of Patent: Feb. 2, 1993

[54] TREATMENT OF OILS USING CHOLINE BASE

[75] Inventors: Glenn L. Roof, Sugar Land; Lawrence N. Kremer, The Woodlands, both of Tex.

[73] Assignee: Baker Hughes Incorporated, Houston, Tex.

[21] Appl. No.: 756,446

[22] Filed: Sep. 9, 1991

[51] Int. Cl.[5] ..... C10G 29/20

[52] U.S. Cl. ..... 208/236; 208/207; 208/208 R; 208/237

[58] Field of Search ..... 208/207, 208 R, 236, 208/237

[56] References Cited

U.S. PATENT DOCUMENTS 4,594,147 6/1986 Roof et al. ..... 208/207

4,867,865 9/1989 Roof ..... 208/236

*Primary Examiner*—Theodore Morris

*Assistant Examiner*—Walter D. Griffin

*Attorney, Agent, or Firm*—Rosenblatt & Associates

[57] ABSTRACT

In accordance with this invention, a method is provided for decreasing hydrogen sulfide atmosphere, over sour heavy fuel oils to a predetermined acceptable level, which comprises treating such fuel oil with an effective amount of a choline base at a temperature above the decomposition temperature of the choline base. Surprisingly, this is effective to treat sour heavy fuel oils having atmospheric hydrogen sulfide content exceeding 5,000 ppm.

6 Claims, No Drawings

TREATMENT OF OILS USING CHOLINE BASE

BACKGROUND OF THE INVENTION

This invention relates to the treatment of "sour" petroleum and coal liquefaction oils containing hydrogen sulfide and other organosulfur compounds such as thiols and thiocarboxylic acids, and more particularly, to improved methods of treating such streams by using choline base.

Petroleum and synthetic coal liquefaction crude oils are converted into finished products in a fuel products refinery, where principally the products are motor gasoline, distillate fuels (diesel and heating oils), and bunker (residual) fuel oil. Atmospheric and vacuum distillation towers separate the crude into narrow boiling fractions. The vacuum tower cuts deeply into the crude while avoiding temperatures above about 800° F. which cause thermal cracking. A catalytic cracking unit cracks high boiling vacuum gas oil into a mixture from light gases to very heavy tars and coke. In general, very heavy virgin residuum (average boiling points greater than 1100° F.) is blended into residual fuel oil or thermally cracked into lighter products in a visbreaker or coker.

The residue or bottoms from the distillation can either be coked in delayed coking drums at temperatures between 900° to 930° F. to produce coke and distilled overhead products or can be shipped and sold directly to be used as fuel in boilers on ships or in power or steam plants.

Industrial fuel oils can also consist of one or more of the following products derived from petroleum: vacuum tower bottoms, catalytically cracked light or heavy gas oils and catalytically cracked clarified oil. A No. 6 fuel oil is an example of such a product. It will typically have a boiling point of 660° F., a specific gravity greater than 1.0° and 45° F. pour point. These products can contain significant amounts of $H_2S$. However, substantial amounts of hydrogen sulfide, as well as mercaptans and organosulfides, may be found in the atmospheric and vacuum distillation tower bottoms, which may be blended into gas oils and fuel oils. When sour heavy fuel oils are to be used as fuel in industrial boilers or in electric utility steam plants or elsewhere, the presence of large amounts of $H_2S$ in the atmosphere above or associated with the oil during transit in barges or ships, or in storage in refinery tanks or user tanks, constitutes a hazard to personnel who are in the vicinity of the storage or transport facilities. Typically, the $H_2S$ specification for such fuel oils is 100 ppm or less.

Heavy fuel oils are very viscous and in order to pump them from one location to another, it is often necessary to heat them to temperatures exceeding 230° F., the decomposition temperature of choline base. The temperature to which the heavy fuel oil is heated is dependent, among other factors, upon the rate of heat loss of the conduit through which the fuel oil is pumped, the velocity of flow through the conduit, and ambient temperatures of the environment through which the conduit passes. In an example of the West Coast Refinery, it is necessary to heat the heavy fuel oil to a temperature of about 400° F. to pump it to a terminal loading facility some 20 miles from the refinery. Heating heavy sour fuel oils increases a hydrogen sulfide atmosphere which may be hazardous to operating personnel.

The prior art relating to the treatment of sour petroleum oils includes methods in which choline base has been employed to treat sour heavy fuel oils to maintain the hydrogen sulfide content in the atmosphere above or associated with such oils at levels within acceptable limits to avoid health hazards to personnel, as disclosed in U.S. Pat. No. 4,867,865. (Choline base also has been used to treat gasoline and other motor fuels to remove organosulfur compounds such as thiols, thiolcarboxylic acids, disulfides and polysulfides, as disclosed in U.S. Pat. No. 4,594,147.) As disclosed in U.S. Pat. No. 4,867,865, a choline base has been used in the past to reduce hydrogen sulfide content of atmospheres above sour heavy fuel oils from as high as 5,000 ppm down to 100 ppm or less by treating such sour oils at temperatures below the decomposition temperature of choline base, which is about 230° F.

DESCRIPTION OF THE INVENTION

In accordance with this invention, a method is provided for decreasing hydrogen sulfide atmosphere over sour heavy fuel oils to a predetermined acceptable level, which comprises treating such fuel oil with an effective amount of a choline base at a temperature above the decomposition temperature of the choline base. Surprisingly, this is effective for treating sour heavy fuel oils having atmospheric hydrogen sulfide content exceeding 5,000 ppm. Fuel oils having a high hydrogen sulfide content effective to produce an atmospheric concentration over it of over 5,000 ppm may be treated with choline base at a temperature below the decomposition temperature of choline base, and the treated oil then heated to a temperature above the decomposition temperature of choline base to move the oil through a conduit to a receiving vessel without reformation of hydrogen sulfide.

In further accordance with this invention, there is provided a method of moving sour heavy fuel oils without producing hazardous amounts of atmospheric hydrogen sulfide, which comprises treating a fuel oil having a temperature above the decomposition temperature of choline base with an amount of choline base effective to reduce the atmospheric hydrogen sulfide over the fuel oil to a predetermined acceptable level, and then moving the treated hot oil at a temperature above the decomposition temperature of choline base through a conduit to a receiving vessel.

EXAMPLE I

A West Coast (U.S.) vacuum tower residual oil containing a light cutter stock was obtained. Hydrogen sulfide was sparged into the fuel until the vapor space above the fuel contained 39,400 ppm by volume at 180° F. Three aliquots of the sparged fuel were then dosed with different amounts of choline base, capped tightly and maintained at 180° F. for two hours, with intermittent vigorous shaking. The aliquot samples were then analyzed for hydrogen sulfide using Drager tubes. The results are set forth in the following table.

TABLE 1

TREATING HIGH LEVELS OF $H_2S$
Fuel = A West Coast Vacuum Resid Containing a Light Cutter Stock

| ADDITIVE | DOSE (ppm-w) | $H_2S$ LEVEL (ppm-v) |
|---|---|---|
| None | — | 39,400 |
| Choline Base | 2,000 | 13,200 |
| Choline Base | 4,000 | 0 |
| Choline Base | 6,000 | 0 |

The data from Table 1 clearly show that very high levels of hydrogen sulfide in residual fuel oil may be treated to reduce atmospheric hydrogen sulfide to even to zero ppm hydrogen sulfide in the atmosphere above the treated residual fuel oil.

EXAMPLE II

An East Coast (U.S.) vacuum residuum slurry oil at a temperature in excess of 300° F. was added directly to vessels containing different doses of choline base. The vessels were allowed to cool to 200° F., were shaken vigorously, and the vapor space was tested for hydrogen sulfide using Drager tubes. The results are set forth in the following table.

TABLE 2

HIGH TEMPERATURE ABATEMENT OF $H_2S$ IN VACUUM RESID
Fuel = An East Coast Slurry Oil Treated at ≈300° F.

| ADDITIVE | DOSE (ppm-w) | $H_2S$ LEVEL (ppm-v) |
|---|---|---|
| None | — | 4,200 |
| Choline Base | 567 | 200 |
| Choline Base | 945 | <50 |
| Choline Base | 1,000 | 0 |

The data from Table 2 show that choline base is active at temperatures above its decomposition temperature to abate hydrogen sulfide.

EXAMPLE III

The same samples that were treated in Example I at 180° F. for two hours, were heated to 392° F. for six hours. A comparison dosage of 14% sodium hydroxide was also tested. After the samples were cooled, they were shaken vigorously and the vapor space was tested for hydrogen sulfide using Drager tubes, with the results which are set forth in the following table.

TABLE 3

NON-REGENERATION OF $H_2S$ WHEN HEATING TREATED FUEL TO 392° F.
Fuel = Same as in first table

| ADDITIVE | DOSE (ppm-w) | INITIAL $H_2S$ (ppm-v) | STRESS TEMP. | FINAL $H_2S$ (ppm-v) |
|---|---|---|---|---|
| None | — | 39,400 | 392° F. | 19,300 |
| Choline B. | 2,000 | 13,200 | 392° F. | Not Done |
| Choline B. | 4,000 | 0 | 392° F. | 2,960 |
| Choline B. | 6,000 | 0 | 392° F. | 190 |
| 14% NaOH | 6,100 | 0 | 392° F. | 668 |

The results of Table 3 show that very little hydrogen sulfide was reformed, if any (the Drager tubes are believed to have detected mercaptan, not $H_2S$) at the stress temperature.

The foregoing show that heavy fuel oils containing hydrogen sulfide effective to create a high hydrogen sulfide content atmosphere over the fuel oil exceeding 5,000 ppm may be treated at a temperature above the decomposition temperature of choline base, or treated at a temperature below the decomposition of choline base and then heated to a temperature exceeding such decomposition temperature, without reforming hydrogen sulfide in the atmosphere in excess of 1% of the pretreatment levels, if at all.

Having now described our invention, variations, modifications and changes within the scope of our invention will be apparent to those of ordinary skill in the art, as set forth in the following claims.

What is claimed is:

1. A method of decreasing hydrogen sulfide atmosphere over sour heavy fuel oils comprising treating such fuel oil with an amount of choline base effective to decrease said atmospheric hydrogen sulfide over said fuel oil at a temperature above the decomposition temperature of choline base.

2. A method of moving sour heavy fuel oils having a high hydrogen sulfide concentration effective to produce an atmospheric hydrogen sulfide over it of over 5,000 ppm without producing hazardous amounts of atmospheric hydrogen sulfide comprising:

(a) treating such fuel oil with an amount of choline base effective to reduce the atmospheric hydrogen sulfide over such fuel oil, (b) such oil either having a temperature above the decomposition temperature of choline base, or if not above the decomposition temperature of choline base, then being heated to a temperature greater than the decomposition temperature of choline base, and then (c) moving the treated heated oil at a temperature greater than said decomposition temperature through a conduit to a receiving vessel.

3. The method of moving sour heavy fuel oils without producing hazardous amounts of atmospheric hydrogen sulfide, comprising:

(a) treating such an oil having a temperature greater than the decomposition temperature of choline base with an amount of choline base effective to reduce the quantity of atmospheric hydrogen sulfide over such oil, and (b) moving the treated hot oil at a temperature greater than said decomposition temperature through a conduit to a receiving vessel.

4. A method of decreasing atmospheric hydrogen sulfide of less than 5,000 ppm over sour heavy fuel oils comprising treating said fuel oil with an amount of chloine base effective to decrease said atmospheric hydrogen sulfide at a temperature above the decomposition temperature of said choline base.

5. A method of decreasing atmospheric hydrogen sulfide of greater than 5,000 ppm over sour heavy fuel oils comprising treating said fuel oil with an amount of choline base effective to decrease said atmospheric hydrogen sulfide at a temperature above the decomposition temperature of said choline base.

6. A method of moving heavy fuel oils having a hydrogen sulfide concentration effective to produce an overlying atmospheric hydrogen sulfide in excess of 5,000 ppm without producing hazardous amounts of atmospheric hydrogen sulfide comprising:

(a) treating said fuel oil having a temperature greater than the decomposition temperature of choline base with an amount of choline base effective to reduce the quantity of atmospheric hydrogen sulfide over said fuel oil; and (b) moving said treated hot oil at a temperature greater than said decomposition temperature through a conduit to a receiving vessel.

* * * * *